US011668257B2

(12) United States Patent
Joseph et al.

(10) Patent No.: US 11,668,257 B2
(45) Date of Patent: Jun. 6, 2023

(54) METHOD FOR SYNCHRONISING A COMBUSTION ENGINE

(71) Applicant: VITESCO TECHNOLOGIES GMBH, Hanover (DE)

(72) Inventors: Fabien Joseph, Toulouse (FR); Stéphane Eloy, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 166 days.

(21) Appl. No.: 17/288,492

(22) PCT Filed: Oct. 24, 2019

(86) PCT No.: PCT/EP2019/079034
§ 371 (c)(1),
(2) Date: Apr. 23, 2021

(87) PCT Pub. No.: WO2020/084055
PCT Pub. Date: Apr. 30, 2020

(65) Prior Publication Data

US 2021/0388783 A1 Dec. 16, 2021

(30) Foreign Application Priority Data

Oct. 24, 2018 (FR) ..... 1859820

(51) Int. Cl.
*F02D 41/00* (2006.01)
*F02D 41/24* (2006.01)

(52) U.S. Cl.
CPC ..... *F02D 41/009* (2013.01); *F02D 41/2438* (2013.01); *F02D 2041/0092* (2013.01)

(58) Field of Classification Search
CPC ..... F02D 41/009; F02D 41/2438; F02D 2041/0092; F02D 2041/0095
See application file for complete search history.

(56) References Cited

U.S. PATENT DOCUMENTS

2002/0112683 A1 8/2002 Kunz
2009/0165542 A1 7/2009 Gray et al.
(Continued)

FOREIGN PATENT DOCUMENTS

CN 101469619 A 7/2009
CN 104100320 A 10/2014
(Continued)

OTHER PUBLICATIONS

English translation of Written Opinion of the ISA for PCT/EP2019/079034 dated Jan. 21, 2020, 4 pages. (Year: 2020).*
(Continued)

*Primary Examiner* — Hung Q Nguyen
*Assistant Examiner* — Mark L. Greene
(74) *Attorney, Agent, or Firm* — Nixon & Vanderhye

(57) ABSTRACT

Disclosed is a method for synchronizing a combustion engine of a motor vehicle, including the steps of detection of the reference position of a first toothed wheel during a rotation of the crankshaft from the measurements sent by a first measuring sensor, detection of rising and falling edges of the teeth of a second toothed wheel during a concomitant rotation of the camshaft from the measurements sent by a second measuring sensor, identification of the detected edges with a first tolerance threshold on the angular position of the camshaft from recorded positions of the edges to synchronize the engine, the recorded positions being predetermined by learning from theoretical positions with a second tolerance threshold on the angular position of the camshaft, the first tolerance threshold being less than the second tolerance threshold, and synchronization of the engine from the identified edges of the teeth of the second toothed wheel.

20 Claims, 2 Drawing Sheets

(56) References Cited

U.S. PATENT DOCUMENTS

| | | | |
|---|---|---|---|
| 2014/0299080 | A1 | 10/2014 | Zouboff et al. |
| 2015/0020581 | A1 | 1/2015 | Stuckert et al. |
| 2015/0114097 | A1 | 4/2015 | Zouboff et al. |
| 2017/0175654 | A1 | 6/2017 | Eom et al. |
| 2018/0347483 | A1 | 12/2018 | Mazenc et al. |

FOREIGN PATENT DOCUMENTS

| | | | | | |
|---|---|---|---|---|---|
| CN | 104329179 | A | | 2/2015 | |
| CN | 104364501 | A | | 2/2015 | |
| CN | 107035561 | A | | 8/2017 | |
| DE | 197 50 024 | | | 5/1999 | |
| EP | 0 831 224 | | | 3/1998 | |
| EP | 2 317 087 | | | 5/2011 | |
| FR | 2 855 217 | | | 11/2004 | |
| GB | 2559472 | A | * | 8/2018 | ..... F02D 41/009 |
| WO | 02/08596 | | | 1/2002 | |
| WO | 2017/088971 | | | 6/2017 | |

OTHER PUBLICATIONS

International Search Report for PCT/EP2019/079034 dated Jan. 21, 2020, 6 pages.
Office Action issued in Chinese Patent Application No. 201980070349.3 dated Oct. 10, 2022.

* cited by examiner

METHOD FOR SYNCHRONISING A COMBUSTION ENGINE

CROSS-REFERENCE TO RELATED APPLICATIONS

This application is the U.S. national phase of International Application No. PCT/EP2019/079034 filed Oct. 24, 2019 which designated the U.S. and claims priority to FR 1859820 filed Oct. 24, 2018, the entire contents of each of which are hereby incorporated by reference.

BACKGROUND OF THE INVENTION

Field of the Invention

The invention relates to the field of fuel injection and more particularly to a method for synchronizing a combustion engine of a motor vehicle. The invention aims in particular to allow rapid and reliable identification of the rising and falling edges of a camshaft target when the engine is started.

Description of the Related Art

In a known manner, a motor vehicle with a heat engine comprises an engine control computer which implements an algorithm for synchronizing the angular position of the crankshaft with that of the camshaft in order to control the injection of fuel at the right time into the cylinders and thus ensure the correct operation of the engine. To this end, the crankshaft and the camshaft each have a target in the form of a toothed wheel. In a current solution, the target of the crankshaft comprises several tens of regularly spaced teeth, one or more teeth being missing at a location on the toothed wheel so as to form a space called the reference position. The camshaft target has a few irregularly spaced teeth, for example three or four, which define as many rising edges and falling edges. In a known manner, the crankshaft makes two complete revolutions while the camshaft makes one complete revolution.

The synchronization of the camshaft with the crankshaft consists in precisely identifying the rising and falling edges of the camshaft target in order to know in which of the first or second revolution the crankshaft is, thus allowing the fuel to be injected in the correct engine cycle. To this end, a crankshaft sensor is mounted opposite the crankshaft target and detects the passage of the teeth of said target and in particular the passage of the reference position in order to determine the angular position, in degrees denoted "° CRK", of the crankshaft from the reference position. Likewise, a camshaft sensor is mounted opposite the camshaft target and detects the passage of the teeth of said target in order to determine the angular position, in degrees denoted "° CAM", of the rising and falling edges of the camshaft relative to the reference position of the crankshaft target.

Before starting the engine, since the actual position of the camshaft target edges relative to the crankshaft reference position is approximate, a tolerance of plus or minus 20° CRK is used by the synchronization algorithm in order to take into account the mechanical tolerances of the target and the mechanical assembly tolerances of the targets with respect to the sensor, otherwise the algorithm could exclude from the detection an edge of the camshaft target which would not be in its theoretical position, and thus remove a misdiagnosis.

The use of such a tolerance makes the synchronization process relatively long, which delays the starting of the engine and presents a significant drawback. In addition, when the rising and falling edges of the teeth of the camshaft target are brought closer, for example of the order of 16° CAM (i.e. 32° CRK<2×20° CRK), the synchronization algorithm can confuse the edges, thus preventing them from being identified correctly. There is therefore the need for a solution making it possible to optimize the synchronization of a combustion engine.

SUMMARY OF THE INVENTION

To this end, the subject of the invention is a method for synchronizing a combustion engine of a motor vehicle, said engine comprising a crankshaft, a first measuring sensor configured to measure the angular position of said crankshaft from a first toothed wheel mounted on said crankshaft, at least one camshaft, and a second measuring sensor configured to measure the angular position of said camshaft from a second toothed wheel mounted on said camshaft, each of said first toothed wheel and second toothed wheel comprising a plurality of teeth, the first toothed wheel comprising at least one free space devoid of teeth constituting a reference position, the position of each tooth of the first toothed wheel relative to the first measuring sensor defining a different angular position of the crankshaft, the position of each tooth of the second toothed wheel relative to the second measuring sensor defining a different angular position of the camshaft, the method being noteworthy in that it comprises the steps of:

- detection of the reference position of the first toothed wheel during a rotation of the crankshaft from the measurements sent by the first measuring sensor,
- detection of a plurality of rising and falling edges of the teeth of the second toothed wheel during a concomitant rotation of the camshaft from the measurements sent by the second measuring sensor,
- identification of the detected edges with a first tolerance threshold on the angular position of the camshaft from recorded positions of said edges in order to synchronize the engine, said recorded positions having been predetermined by learning from theoretical positions with a second tolerance threshold on the angular position of the camshaft, said first tolerance threshold being less than said second tolerance threshold,
- synchronization of the engine from the identified edges of the teeth of the second toothed wheel.

The rising and falling edges of the second toothed wheel mounted on a camshaft are defined by exact theoretical positions, in particular with regard to the position of the crankshaft. However, the manufacture of these wheels, and their assembly, lead in particular to position variations or position tolerances of a camshaft wheel with respect, in particular, to the wheel of the crankshaft. Therefore, according to the known prior art, a (second) tolerance threshold on the angular position of the camshaft is defined in order to take into account these possible position variations. According to the invention, it is proposed to use a learning of the actual position of the edges of a camshaft wheel during successive synchronizations on the basis of the second tolerance threshold, for example by averaging these positions as explained later, in order to define another (first) tolerance threshold on the angular position of the camshaft, which is smaller than the (second) tolerance threshold, in order to avoid erroneous detections of edges and/or absence of edge detection, and reduce the synchronization time. The use of the second tolerance threshold makes it possible to easily synchronize the engine with a wide tolerance threshold, for example when leaving the factory or following maintenance, while the use of the first threshold makes it possible, once the standard synchronization has been carried out with the second tolerance threshold and the positions of the detected edges resulting from this synchronization have been recorded, to reduce the synchronization time, the first threshold being less than the second threshold. The use of the first tolerance threshold thus limits the risk of two successive teeth of the second toothed wheel being confused. The method according to the invention advantageously makes it possible to optimize the synchronization of the engine regardless of the configuration of the teeth of the second toothed wheel.

Preferably, the first tolerance threshold is strictly less than half of the minimum angle difference existing between two edges of teeth of the second toothed wheel in order to identify each edge of teeth of the second toothed wheel with certainty. For example, the first tolerance threshold may be less than, or of the order of plus or minus, 10° CAM (20° CRK), for example of the order of plus or minus 6° CAM (12° CRK).

The learning of the positions recorded from theoretical positions of the edges of the second toothed wheel with the second tolerance threshold on the angular position of the camshaft is for example carried out in the factory when the vehicle leaves the production line or else following a replacement of the timing gear, for example during the first starts of the engine. Following this learning, the first tolerance threshold is used in order to reduce the synchronization time.

Preferably, the method is implemented before starting the engine. What is meant by starting of the engine is the start of combustion in the cylinders of the engine. Thus, the time before the engine is started is limited by virtue of using the actual positions.

According to one aspect of the invention, the positions of the edges of the second toothed wheel determined during the learning are recorded in a memory area of the vehicle so that they can be reused subsequently for the following synchronizations.

Advantageously, the learning comprises a series of synchronizations of the engine from the second tolerance threshold, the average of the positions determined for each edge of the second toothed wheel during this series of synchronizations being calculated and recorded to then be used during subsequent synchronizations with the first tolerance threshold. This makes it possible to refine the recorded positions of the learning phase and thus to further reduce the synchronization time of the engine in standard use of the vehicle (i.e. outside the learning phase).

The invention also relates to a computer for a vehicle, said vehicle comprising a combustion engine comprising a crankshaft, a first measuring sensor configured to measure the angular position of said crankshaft from a first toothed wheel mounted on said crankshaft, at least one camshaft, and a second measuring sensor configured to measure the angular position of said one camshaft from a second toothed wheel mounted on said camshaft, each of said first toothed wheel and second toothed wheel comprising a plurality of teeth, the first toothed wheel comprising at least one free space devoid of teeth constituting a reference position, the position of each tooth of the first toothed wheel relative to the first measuring sensor defining a different angular position of the crankshaft, the position of each tooth of the second toothed wheel relative to the second measuring sensor defining a different angular position of the camshaft, the computer being noteworthy in that it is configured to:

- detect the reference position of the first toothed wheel during a rotation of the crankshaft from the measurements sent by the first measuring sensor,
- detect a plurality of rising and falling edges of the teeth of the second toothed wheel during a concomitant rotation of the camshaft from the measurements sent by the second measuring sensor,
- identify detected edges with a first tolerance threshold on the angular position of the camshaft from recorded positions of said edges in order to synchronize the engine, said recorded positions having been predetermined by learning from theoretical positions with a second tolerance threshold on the angular position of the camshaft, said first tolerance threshold being less than said second tolerance threshold.

Preferably, the first tolerance threshold is strictly less than half of the minimum angle difference existing between two edges of teeth of the second toothed wheel in order to identify each edge of teeth of the second toothed wheel with certainty. For example, the first tolerance threshold may be less than, or of the order of plus or minus, 10° CAM (20° CRK), for example of the order of plus or minus 6° CAM (12° CRK).

The learning of the positions recorded from theoretical positions of the edges of the second toothed wheel with the second tolerance threshold on the angular position of the camshaft is for example carried out in the factory when the vehicle leaves the production line or else following a replacement of the timing gear, for example during the first starts of the engine. Following this learning, the first tolerance threshold is used in order to reduce the synchronization time.

Preferably, the computer is configured to control the synchronization of the engine before starting said engine.

According to one aspect of the invention, the computer comprises a memory area suitable for recording the positions of the edges of the second toothed wheel determined during the learning so that they can be reused subsequently for the following synchronizations.

Advantageously, the computer is configured, during a learning phase, to perform a series of synchronizations of the engine from the second tolerance threshold and to calculate the average of the positions determined for each edge of the second toothed wheel during this series of synchronizations and to record the calculated averages in the memory area.

The invention also relates to a motor vehicle comprising:

- a combustion engine, said engine comprising a crankshaft, a first measuring sensor configured to measure the angular position of said crankshaft from a first toothed wheel mounted on said crankshaft, at least one camshaft, and a second measuring sensor configured to measure the angular position of said camshaft from a second toothed wheel mounted on said camshaft, each of said first toothed wheel and second toothed wheel comprising a plurality of teeth, the first toothed wheel comprising at least one free space devoid of teeth constituting a reference position, the position of each tooth of the first toothed wheel relative to the first measuring sensor defining a different angular position of the crankshaft, the position of each tooth of the second toothed wheel relative to the second measuring sensor defining a different angular position of the camshaft,
- a computer as described above.

Other features and advantages of the invention will become apparent from the following description, given with reference to the appended figures that are given by way of nonlimiting examples and in which identical references are given to similar objects.

DESCRIPTION OF THE PREFERRED EMBODIMENTS

The invention will be presented hereinafter in relation to an implementation in a motor vehicle. However, any implementation in a different context, in particular for any vehicle comprising a combustion engine in which it is necessary to synchronize a crankshaft and a camshaft, is also covered by the present invention.

Figure 1:
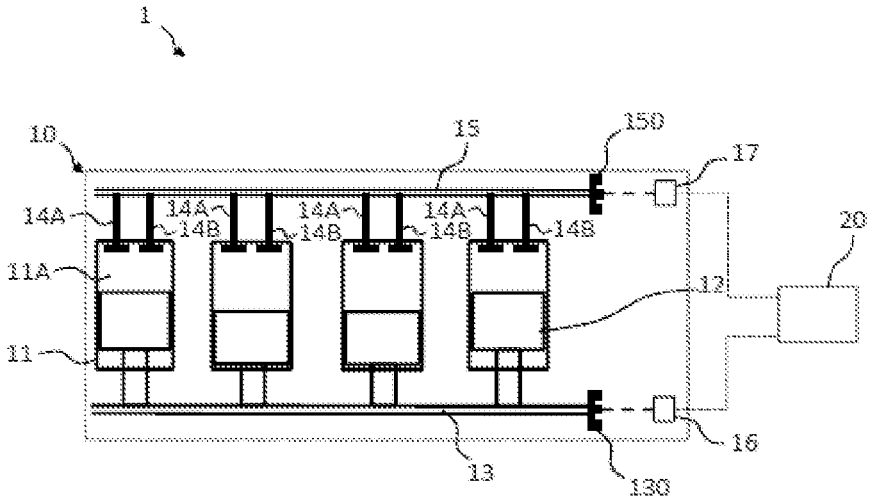
FIG. 1 schematically illustrates one embodiment of a vehicle according to the invention.

As illustrated in FIG. 1, the vehicle 1 according to the invention comprises a combustion engine 10 and a computer 20.

The combustion engine 10 comprises, in a known manner, a plurality of cylinders 11 each delimiting a combustion chamber 11A in which there slides a piston 12 whose movement is driven by compression and expansion of the gases resulting from the combustion of a mixture of air and fuel introduced into the combustion chambers 11A. The air and the gases are introduced and expelled respectively via intake valves 14A and exhaust valves 14B, which are connected, in this example, to a single camshaft 15. However, the engine 10 of the vehicle could just as easily comprise two camshafts 15, one assigned to the intake valves 14A and the second to the exhaust valves 14B. Similarly, in this example, each cylinder 11 is connected to one intake valve 14A and one exhaust valve 14B; however, each cylinder 11 could also be connected to a plurality of intake valves 14A and a plurality of exhaust valves 14B. The camshaft 15, which is set in rotation, makes it possible to alternately open and close the intake valves 14A and the exhaust valves 14B of each combustion chamber 11A.

In this preferred example, the engine 10 is in particular of the four-stroke engine type. Thus, during the operation of the engine 10, four operating phases are necessary for each cylinder 11: a phase of admitting air and fuel into the combustion chamber 11A of the cylinder 11, a phase of compressing the mixture obtained, after which its combustion will take place, a phase of expansion of the gases resulting from the combustion of the mixture, generating the thrust of the piston 12, and a phase of exhausting the gases out of the combustion chamber 11A. These four phases form a repeating engine cycle. During the intake phase and the expansion phase, the piston 12 descends to the bottom position. During the compression phase and the exhaust phase, the piston 12 rises to the top position.

The set of pistons 12 is connected to a crankshaft 13, the rotation of which, brought about by the thrust of each piston 12, allows the storage of kinetic energy by a flywheel (not shown), driving the wheels of the vehicle to rotate. In the remainder of the description, the angular position of the crankshaft 13 is expressed in degrees, denoted "° CRK", and the angular position of the camshaft 15 is expressed in degrees, denoted "° CAM". It will be recalled that an engine cycle corresponds to two rotations of 360° CRK of the crankshaft, which corresponds to only one rotation of 360° CAM of the camshaft 15, so that 2° CRK is equal to 1° CAM.

Figure 2:
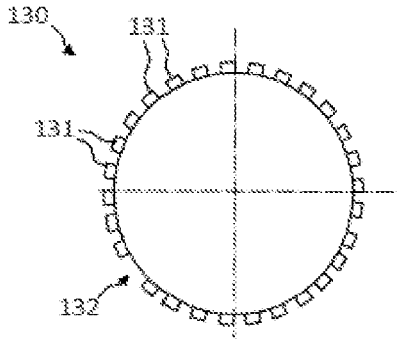
FIG. 2 schematically illustrates a first crankshaft toothed wheel.

The crankshaft 13 comprises a target in the form of a first toothed wheel 130, an example of which is illustrated in FIG. 2, comprising a predetermined number of regularly spaced teeth 131, as well as a free space 132 without teeth corresponding to a reference position of the crankshaft 13. Since such a first toothed wheel 130 is known per se, it will not be described in more detail here. Note further that the first toothed wheel 130 could comprise more than one free space 132 in another embodiment.

Figure 4:
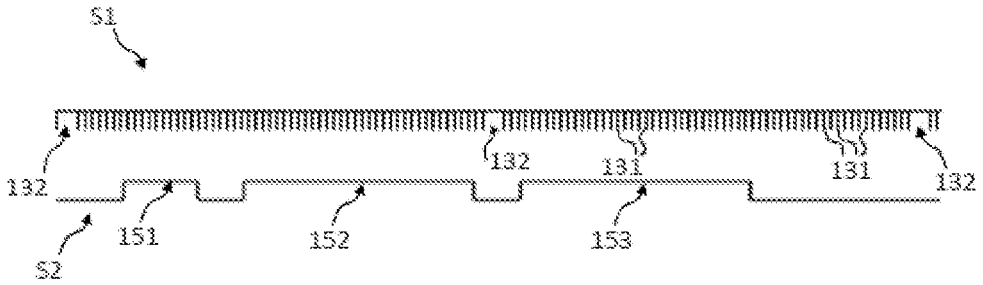
FIG. 4 schematically illustrates an example of signals emitted by a first measuring sensor mounted opposite the first toothed wheel of FIG. 2 and by a second measuring sensor mounted opposite the second toothed wheel of FIG. 3.

Again with reference to FIG. 1, a first measuring sensor 16 is mounted opposite the first toothed wheel 130 so as to allow the detection, by the computer 20, of the reference position 132 and the counting of the number of teeth 131 passing in front of said first measuring sensor 16 from the reference position 132 when the crankshaft 13 is driven to rotate. More precisely, the first measuring sensor 16 is configured to deliver a first signal S1, an example of which is illustrated in FIG. 4, comprising rising and falling edges representative of the rising or falling edges of the teeth 131 and of the reference position 132, allowing the computer 20 to determine the angular position from 0° CRK to 360° CRK of the crankshaft 13 relative to said first measuring sensor 16. As a variant, the first measuring sensor 16 could be configured to itself detect the reference position 132, count the teeth 131 and send this information to the computer 20 without this limiting the scope of the present invention.

Figure 3:
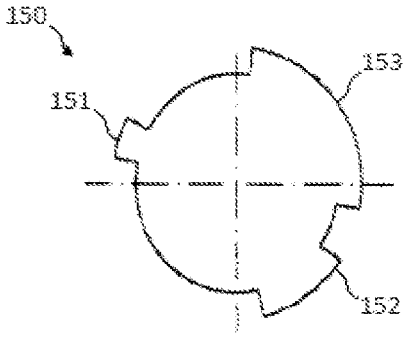
FIG. 3 schematically illustrates a second camshaft toothed wheel.

The camshaft 15 also comprises a target in the form of a second toothed wheel 150, an example of which is illustrated in FIG. 3, comprising a predetermined number of irregularly spaced teeth 151, 152, 153. Since such a second toothed wheel 150 is known per se, it will not be described in more detail here.

With reference to FIG. 1, a second measuring sensor 17 is mounted opposite the second toothed wheel 150 so as to allow the determination of the angular position of said camshaft 15. More precisely, the second measuring sensor 17 is configured to deliver a second signal S2, an example of which is illustrated in FIG. 4, comprising rising and falling edges representative of the teeth 151, 152, 153 and which allows the computer 20 to determine the angular position from 0° CAM to 360° CAM of the camshaft 15 with respect to said second measuring sensor 17. As a variant, the second measuring sensor 17 could be configured to itself detect the position of the teeth 151, 152, 153 and send this information to the computer 20 without this limiting the scope of the present invention.

The first measuring sensor 16 and the second measuring sensor 17 can in particular be in the form of a Hall effect sensor detecting the rising and falling edges. Alternatively, the first measuring sensor 16 and the second measuring sensor 17 can be configured to detect only rising edges or only falling edges in order to limit costs.

During an engine cycle, the crankshaft 13 turns two revolutions and the camshaft 15 turns only one revolution. In other words, the crankshaft 13 turns twice as much as the camshaft 15. The free space 132 is thus detected twice on the first signal S1 during a cycle. Thus, when a hollow space 132 is detected, the camshaft 15 can be in two different positions. Now, the fuel injection moment depends on the position of the camshaft 15. Thus, in order to allow the operation of the engine 10, the position of the camshaft 15 relative to the crankshaft 13 must be known precisely in order to optimize the fuel injection control in the engine 10. It is then said that the engine 10 must be synchronized.

To this end, the computer 20 is configured to detect the reference position of the first toothed wheel 130 during a rotation of the crankshaft 13 from the measurements sent by the first measuring sensor 16.

The computer 20 is configured to detect a plurality of rising and falling edges of the teeth 151, 152, 153 of the second toothed wheel 150 during a concomitant rotation of the camshaft 15 from the measurements sent by the second measuring sensor 17.

The computer 20 is configured to identify detected edges with a first tolerance threshold on the angular position of the camshaft 15 from recorded positions of said edges in order to synchronize the engine 10, said recorded positions having been predetermined by learning from theoretical positions with a second tolerance threshold on the angular position of the camshaft 15, said first tolerance threshold being less than said second tolerance threshold, as will be described below.

Figure 5:
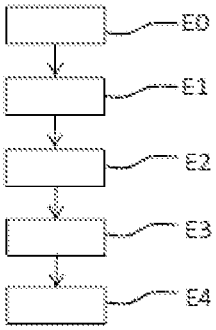
FIG. 5 schematically illustrates one embodiment of the method according to the invention.

With reference to FIG. 5, there will now be described an example of implementation of the method for synchronizing the crankshaft 13 and the camshaft 15 according to the invention.

On leaving the factory of the vehicle 1 or following maintenance, for example following the change of the timing gear, a theoretical position is determined for each tooth 151, 152, 153 of the second toothed wheel 150 during a preliminary learning step E0. More precisely, the crankshaft 13 and the camshaft 15 are first of all driven to rotate so that the first measuring sensor 16 and the second measuring sensor 17 detect the teeth 131, 151, 152, 153 and the free space 132. The first measuring sensor 16 detects the various teeth 131 and the free space 132 of the first toothed wheel 130 and generates a first signal S1. The second measuring sensor 17 detects the teeth 151, 152, 153 of the second toothed wheel 150 and generates a second signal S2.

The computer 20 receives the first signal S1 and the second signal S2 in order to identify the rising and falling edges of the teeth 151, 152, 153 of the second toothed wheel 150 with respect to the reference position (free space 132) of the crankshaft 13 and thus synchronize the engine 10. Preferably, the identification of the teeth 131, 151, 152, 153 and of the free space 132 is carried out in one rotation of the camshaft 15, i.e. two rotations of the crankshaft 13 at most.

During this preliminary learning step E0, the computer 20 applies a tolerance equal to a second tolerance threshold, for example of the order of plus or minus 20° CRK, which corresponds to the manufacturing and assembly tolerances of the engine 10. Such a second tolerance threshold requires a relatively long synchronization time in order to ensure the correct identification of the edges. Once determined, the theoretical positions of the edges of the second toothed wheel 150 are recorded in a memory area of the vehicle 1, for example a memory area of the computer 20.

In order to refine the determination of the theoretical position of each edge of the teeth 151, 152, 153 of the second toothed wheel 150, the learning can comprise a series of synchronizations of the engine 10 from the second tolerance threshold, the average of the positions determined for each edge of the second toothed wheel 150 during this series of synchronizations being calculated and recorded to then be used during subsequent synchronizations with the first tolerance threshold.

Once the preliminary learning step E0 has been carried out, the synchronization method according to the invention is implemented during the operation of the vehicle 1, preferably before each start of the engine 10.

To do this, the computer 20 detects, in a step E1, the reference position of the first toothed wheel 130 during a rotation of the crankshaft 13 from the measurements sent by the first measuring sensor 16. At the same time, the computer 20 detects, in a step E2, a plurality of rising and falling edges of the teeth 151, 152, 153 of the second toothed wheel 150 during a concomitant rotation of the camshaft 15 from the measurements sent by the second measuring sensor 17.

The computer 20 then identifies, in a step E3, the detected edges with a first tolerance threshold on the angular position of the camshaft 15 from positions, recorded during the preliminary learning step E0, of said edges in order to synchronize the engine 10.

Finally, the computer 20 synchronizes the engine 10, in a step E4, from the identified edges of the teeth 151, 152, 153 of the second toothed wheel 150.

The first tolerance threshold is less than the second tolerance threshold in order to allow rapid synchronization of the engine 10. The first tolerance threshold can be chosen as a function of the effects of engine speed of the engine 10 and/or of its temperature. For example, the first tolerance threshold is preferably less than, or of the order of plus or minus, 10° CAM, for example of the order of plus or minus 6° CAM (12° CRK).

Figure 6:
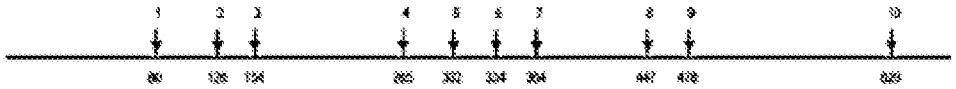
FIG. 6 illustrates an example of the position of the edges of the teeth of a second toothed wheel.

Preferably, the first tolerance threshold is strictly less than half of the minimum angle difference existing between two edges of teeth 151, 152, 153 of the second toothed wheel 150 in order to be certain not to confuse the edges, and in particular the two least spaced edges, of the second toothed wheel 150. FIG. 6 depicts a schematic example of the position of the edges of the teeth 151, 152, 153 of a second toothed wheel 150. In this example, the minimum difference between two edges is observed for edges 2 and 3 and is equal to 154-126=28° CRK. Thus, by choosing a first tolerance threshold strictly less than half of 28° CRK, i.e. 14° CRK (equal to 7° CAM), for example a first tolerance threshold of plus or minus 12° CRK (6° CAM), the identification of edge 2 and edge 3 will be certain because the detection of edge 2 and edge 3 will not fall within the same interval of 25° CRK wide and more.

The method of the invention makes it possible, during the life of the vehicle 1, owing to the use of recorded theoretical positions, to apply a reduced tolerance to quickly synchronize the engine 10. The synchronization of the engine 10 before it was started has been presented. However, it goes without saying that such synchronization can be achieved at any time, especially when the engine is operating at a high speed and synchronization has been lost.

The invention claimed is:

1. A method for synchronizing a combustion engine (10) of a motor vehicle (1), said combustion engine (10) comprising a crankshaft (13), a first measuring sensor (16) configured to measure the angular position of said crankshaft (13) from a first toothed wheel (130) mounted on said crankshaft (13), at least one camshaft (15), and a second measuring sensor (17) configured to measure the angular position of said camshaft (15) from a second toothed wheel (150) mounted on said camshaft (15), each of said first toothed wheel (130) and second toothed wheel (150) comprising a plurality of teeth (131, 151, 152, 153), the first toothed wheel (130) comprising at least one free space (132) devoid of teeth (131) constituting a reference position, the position of each tooth (131) of the first toothed wheel (130) relative to the first measuring sensor (16) defining a different angular position of the crankshaft (13), the position of each tooth (151, 152, 153) of the second toothed wheel (150) relative to the second measuring sensor (17) defining a different angular position of the camshaft (15), the method comprising the steps of:

detecting (E1) the reference position (132) of the first toothed wheel (130) during a rotation of the crankshaft (13) from the measurements sent by the first measuring sensor (16), detecting (E2) a plurality of rising and falling edges of the teeth (151, 152, 153) of the second toothed wheel (150) during a concomitant rotation of the camshaft (15) from the measurements sent by the second measuring sensor (17), identifying (E3) the detected edges with a first tolerance threshold on the angular position of the camshaft (15) from recorded positions of said edges in order to synchronize the combustion engine (10), said recorded positions having been predetermined by learning (E0) from theoretical positions with a second tolerance threshold on the angular position of the camshaft (15), said first tolerance threshold being less than said second tolerance threshold, synchronizing (E4) the combustion engine (10) from the identified edges of the teeth (151, 152, 153) of the second toothed wheel (150).

2. The method as claimed in claim 1, in which the first tolerance threshold is strictly less than half of the minimum angle difference existing between two edges of the teeth (151, 152, 153) of the second toothed wheel (150).

3. The method as claimed in claim 2, in which the first tolerance threshold is less than, or about of the order of plus or minus, 10° CAM (20° CRK).

4. The method as claimed in claim 2, said method being implemented before starting the combustion engine (10).

5. The method as claimed in claim 2, in which the positions of the edges of the second toothed wheel (150) determined during the learning (E0) are recorded in a memory area of the motor vehicle (1).

6. The method as claimed in claim 2, in which the learning (E0) comprises a series of synchronizations of the combustion engine (10) from the second tolerance threshold, the average of the positions determined for each edge of the second toothed wheel (150) during this series of synchronizations being calculated and recorded to then be used during subsequent synchronizations with the first tolerance threshold.

7. The method as claimed in claim 1, in which the first tolerance threshold is less than, or about plus or minus, 10° CAM (20° CRK).

8. The method as claimed in claim 7, said method being implemented before starting the combustion engine (10).

9. The method as claimed in claim 7, in which the positions of the edges of the second toothed wheel (150) determined during the learning (E0) are recorded in a memory area of the motor vehicle (1).

10. The method as claimed in claim 7, in which the learning (E0) comprises a series of synchronizations of the combustion engine (10) from the second tolerance threshold, the average of the positions determined for each edge of the second toothed wheel (150) during this series of synchronizations being calculated and recorded to then be used during subsequent synchronizations with the first tolerance threshold.

11. The method as claimed in claim 1, said method being implemented before starting the combustion engine (10).

12. The method as claimed in claim 11, in which the positions of the edges of the second toothed wheel (150) determined during the learning (E0) are recorded in a memory area of the motor vehicle (1).

13. The method as claimed in claim 11, in which the learning (E0) comprises a series of synchronizations of the combustion engine (10) from the second tolerance threshold, the average of the positions determined for each edge of the second toothed wheel (150) during this series of synchronizations being calculated and recorded to then be used during subsequent synchronizations with the first tolerance threshold.

14. The method as claimed in claim 1, in which the positions of the edges of the second toothed wheel (150) determined during the learning (E0) are recorded in a memory area of the motor vehicle (1).

15. The method as claimed in claim 14, in which the learning (E0) comprises a series of synchronizations of the combustion engine (10) from the second tolerance threshold, the average of the positions determined for each edge of the second toothed wheel (150) during this series of synchronizations being calculated and recorded to then be used during subsequent synchronizations with the first tolerance threshold.

16. The method as claimed in claim 1, in which the learning (E0) comprises a series of synchronizations of the combustion engine (10) from the second tolerance threshold, the average of the positions determined for each edge of the second toothed wheel (150) during this series of synchronizations being calculated and recorded to then be used during subsequent synchronizations with the first tolerance threshold.

17. A computer (20) for a vehicle (1), said vehicle (1) comprising a combustion engine (10) comprising a crankshaft (13), a first measuring sensor (16) configured to measure the angular position of said crankshaft (13) from a first toothed wheel (130) mounted on said crankshaft (13), at least one camshaft (15), and a second measuring sensor (17) configured to measure the angular position of said camshaft (15) from a second toothed wheel (150) mounted on said camshaft (15), each of said first toothed wheel (130) and second toothed wheel (150) comprising a plurality of teeth (131, 151, 152, 153), the first toothed wheel (130) comprising at least one free space (132) devoid of teeth (131) constituting a reference position, the position of each tooth (131) of the first toothed wheel (130) relative to the first measuring sensor (16) defining a different angular position of the crankshaft (13), the position of each tooth (151, 152, 153) of the second toothed wheel (150) relative to the second measuring sensor (17) defining a different angular position of the camshaft (15), the computer (20) being configured to:

detect the reference position (132) of the first toothed wheel (130) during a rotation of the crankshaft (13) from the measurements sent by the first measuring sensor (16), detect a plurality of rising and falling edges of the teeth (151, 152, 153) of the second toothed wheel (150) during a concomitant rotation of the camshaft (15) from the measurements sent by the second measuring sensor (17), identify the detected edges with a first tolerance threshold on the angular position of the camshaft (15) from recorded positions of said edges in order to synchronize the combustion engine (10), said recorded positions having been predetermined by learning from theoretical positions with a second tolerance threshold on the angular position of the camshaft (15), said first tolerance threshold being less than said second tolerance threshold, synchronize the combustion engine (10) from the identified edges of the teeth (151, 152, 153) of the second toothed wheel (150).

18. The computer (20) as claimed in claim 17, said computer (20) comprising a memory area suitable for recording the positions of the edges of the second toothed wheel (150) determined during the learning so that they can be reused subsequently for following synchronizations.

19. The computer (20) as claimed in claim 18, said computer (20) being configured, during a learning phase, to:

perform a series of synchronizations of the combustion engine (10) from the second tolerance threshold, calculate the average of the positions determined for each edge of the second toothed wheel (150) during this series of synchronizations, and record the calculated averages in the memory area.

20. A motor vehicle (1) comprising:

a combustion engine (10) comprising a crankshaft (13), a first measuring sensor (16) configured to measure the angular position of said crankshaft (13) from a first toothed wheel (130) mounted on said crankshaft (13), at least one camshaft (15), and a second measuring sensor (17) configured to measure the angular position of said camshaft (15) from a second toothed wheel (150) mounted on said camshaft (15), each of said first toothed wheel (130) and second toothed wheel (150) comprising a plurality of teeth (130, 151, 152, 153), the first toothed wheel (130) comprising at least one free space (132) devoid of teeth (131) constituting a reference position, the position of each tooth (131) of the first toothed wheel (130) relative to the first measuring sensor (16) defining a different angular position of the crankshaft (13), the position of each tooth (151, 152, 153) of the second toothed wheel (150) relative to the second measuring sensor (17) defining a different angular position of the camshaft (15), and the computer (20) as claimed in claim 7.

* * * * *